United States Patent [19]

Marozzi

[11] 4,145,967

[45] Mar. 27, 1979

[54] ENLARGED INK SUPPLY CARTRIDGE FOR MARKING APPARATUS

[76] Inventor: Alfred A. Marozzi, 3 Cheryl Rd., Pine Brook, N.J. 07058

[21] Appl. No.: 854,066

[22] Filed: Nov. 22, 1977

[51] Int. Cl.[2] ..... B41K 1/42

[52] U.S. Cl. ..... 101/333; 101/36; 101/41; 101/328; 118/260

[58] Field of Search ..... 118/260, 268, 243; 101/333, 330, 329, 328, 36, 41

[56] References Cited

U.S. PATENT DOCUMENTS

| | | | |
|---|---|---|---|
| 1,856,882 | 5/1932 | Myers | 118/268 X |
| 2,050,794 | 8/1936 | Humphner | 118/268 X |
| 2,526,571 | 10/1950 | Markes | 118/260 |
| 3,254,624 | 6/1966 | Beseneck | 118/268 |
| 3,804,016 | 4/1974 | Marozzi et al. | 101/333 |

*Primary Examiner*—John McIntosh

*Attorney, Agent, or Firm*—Clarence A. O'Brien; Harvey B. Jacobson

[57] ABSTRACT

A relatively large supply of fast drying ink is stored by an ink supply device having an elongated tubular housing connected at one axial end to a transversely enlarged ink reservoir extension. A wick extends from the ink in the reservoir through a restricted passage formed in the tubular housing by an indentation to conduct capillary flow of ink to a foam filler retained by the indentation in contact with a filter assembly closing the other opened end of the tubular housing through which the ink is dispensed to a marking device.

15 Claims, 5 Drawing Figures

ENLARGED INK SUPPLY CARTRIDGE FOR MARKING APPARATUS

BACKGROUND OF THE INVENTION

This invention relates to the supply of liquid ink from replaceable ink storing cartridges to the imprinting surfaces of a print head associated with a marking apparatus.

Various types of high speed marking devices for random, intermittant and continuous imprinting of indicia on cartons, containers, packaging film and other such surfaces are provided with replaceable cartridges within which a fast drying ink is stored. In one type of such marking device, as disclosed, for example, in my prior U.S. Pat. No. 3,804,016, the cartridge housing is mounted for limited axial movement against a spring bias in response to intermittant contact pressure exerted by a print head projected into an opening at one end of the cartridge housing from which the liquid ink is controllably dispensed. In other types of marking devices, the liquid ink is dispensed from the open end of the cartridge housing to a rotary transfer roller. The latter type of marking device is disclosed, for example, in my prior U.S. Pat. No. 3,662,682. According to the latter patent, the cartridge is inserted into an enclosure having an opening from which an ink transfer roller projects externally of the enclosure to transfer ink to a rotary print head. The roller is in contact with an absorbant filler retained in the cartridge housing internally of the enclosure to prevent rapid evaporation of the fast drying ink. In yet another arrangement, the ink transfer roller is rotatably mounted by a cartridge holding bracket between the open end of the cartridge housing and a rotary print head. In all cases, the cartridge has an axially elongated, tubular housing, closed at the axial end opposite the open end into which a print head or transfer roller projects, in order to store a liquid body of ink spaced from the opening by a foam type of absorbent filler through which the ink restrictively flows by capillary action as the filler is physically acted on by contact with the print head or roller. The filler and any filter assembly spacing it from the open end of the cartridge housing, restricts ink outflow at a controlled rate and prevents rapid evaporation of the ink by limiting its exposure to the air so that the marking device may be operated for a reasonable period of time before replacement or recharging of the ink storing cartridge is required. The use of a tubular shaped cartridge housing facilitates installation and withdrawal from all types of marking devices as aforementioned.

In the interest of reducing operating costs as well as improving imprint quality, it is desirable that the effective life of the ink storing cartridge be prolonged for use in the aforementioned types of marking devices. A mere dimensional enlargement of the cartridge for this purpose is, however, an unsatisfactory solution because of the size of existing marking devices and the installations associated with any new marking devices. It must also be appreciated that any volumetric increase in the ink storing capacity of the ink cartridge must be effected without disturbing the ink flow rate characteristics associated with present cartridges and must also maintain the minimal air exposure attributes to prevent rapid evaporation of the liquid ink.

It is, therefore, an important object of the present invention to provide a replaceable ink supply cartridge for marking devices associated with high speed operations, having a longer effective life than cartridges heretofore available, without any sacrifice of imprinting quality and without requiring extensive or costly modification of existing marking devices and installations.

PRIOR ART STATEMENT

Several prior U.S. patents showing in general liquid dispensers or applicators having a reservoir chamber for the liquid, in communication with an absorbent body exposed at a limited surface remote from the reservoir chamber are presently known. Separate reservoir and absorbent body holding chambers having a restricted flow passage therebetween are disclosed in U.S. Pat. Nos. 438,193, 2,764,958 and 3,599,566. The arrangements shown in U.S. Pat. Nos. 3,654,863 and 3,599,566 are expressly designed to prevent rapid evaporation of volatile or fast drying liquid inks. In U.S. Pat. No. 3,254,624, an elongated wick establishes capillary flow of liquid ink from a reservoir chamber to an absorbent applicator body of an inking cartridge.

On information and belief, applicant and those substantively involved in the preparation of the present application, are not aware of any prior art more relevant than applicant's own prior patents aforementioned and the other prior patents referred to herein. Further, it is believed that the claims presented distinguish over the prior art made of record herein with respect to the following described features.

SUMMARY OF THE INVENTION

In accordance with the present invention, the liquid storing capacity of an ink supply cartridge is increased thereby extending the useful life of the cartridge to an unexpected degree by providing a transversely enlarged extension to the otherwise closed axial end of the tubular cartridge housing. The absorbent filler body within the tubular housing is retained therein abutting a movable filter assembly at the open end, by means of an inwardly extending formation or indentation which also forms a restricted passage through which a wick extends. The wick is knotted to seal the reservoir chamber and prevent withdrawal of the wick from contact with the filler body. The wick also conducts flow by capillary action to the filler from a body of liquid in the transversely enlarged extension enclosing a reservoir chamber of substantial volume.

These together with other objects and advantages which will become subsequently apparent reside in the details of construction and operation as more fully hereinafter described and claimed, reference being had to the accompanying drawings forming a part thereof, wherein like numerals refer to like parts throughout.

BRIEF DESCRIPTION OF THE DRAWING FIGURES

DETAILED DESCRIPTION OF PREFERRED EMBODIMENTS

Figure 1:
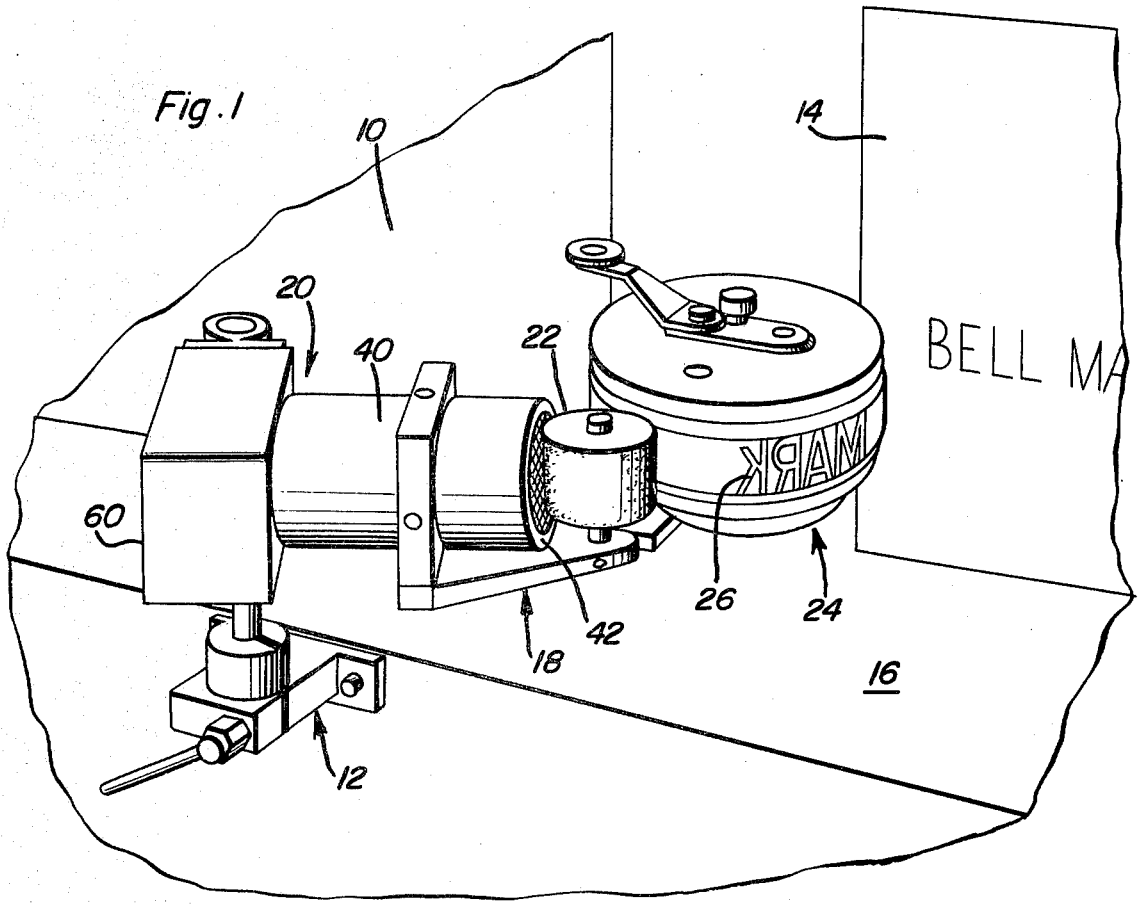
FIG. 1 is a perspective view showing a rotary print type of carton marking apparatus with the ink supply cartridge of the present invention installed therein.

Referring now to the drawings in detail, FIG. 1 illustrates one type of high speed marking apparatus generally referred to by reference numeral 10 fixedly positioned by means of a mounting bracket 12 for imprinting cartons 14 adapted to be moved past a marking station along surface 16. In this type of marking apparatus, the adjustably positioned frame of the apparatus includes a bracket 18 for holding a replaceable ink supply cartridge 20 of the present invention in operative relation to a rotatable ink transfer roller 22 through which ink is transferred to a rotary print head 24. The liquid ink dispensed from the cartridge 20 and applied to the periphery of the roller 22 wets the print type 26 on the rotary print head so as to mark or imprint indicia on the passing surfaces of the cartons 14 during rolling contact with the rotary print head in a manner well known in the art.

An axially alongated ink supply cartridge adapted to apply ink to a transfer roller in rolling contact with a rotary print head is also disclosed in my prior U.S. Pat. No. 3,662,682 aforementioned. Thus, a cartridge similar to that shown in FIG. 1 may also be utilized as the ink supply source.

Figure 2:
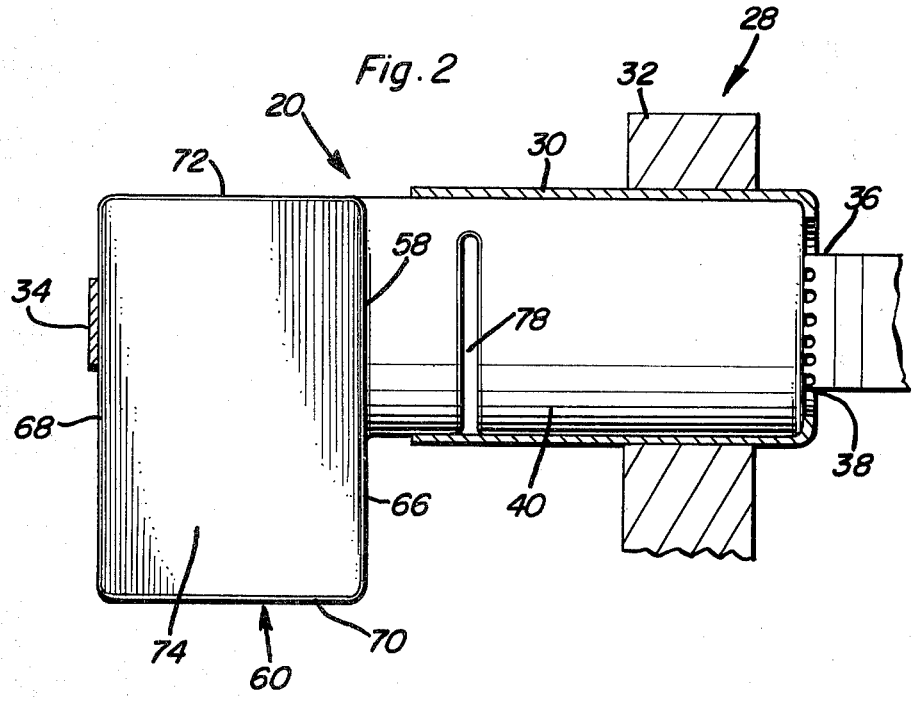
FIG. 2 is a partial side section view of a portion of an intermittant, reciprocable print head type of marking apparatus utilizing the enlarged ink supply cartridge of the present invention.

FIG. 2 illustrates yet another installation for the ink supply cartridge 20 in a marking apparatus 28 of the type disclosed in my prior U.S. Pat. No. 3,804,016 aforementioned. In this type of marking apparatus, the cartridge 20 is mounted by a sleeve 30 fixed to frame 32 for limited axial movement against the bias of a spring 34 in response to intermittant contact pressure applied by a print head 36. The print head 36 is displaced between an inking position as shown in FIG. 2 and a marking position in accordance with operational modes described in my prior U.S. Pat. No. 3,804,016. In the inking position, the movable print head element 36 is projected into the open axial end 38 of the cartridge 20 so as to receive liquid ink therefrom.

Figure 4:
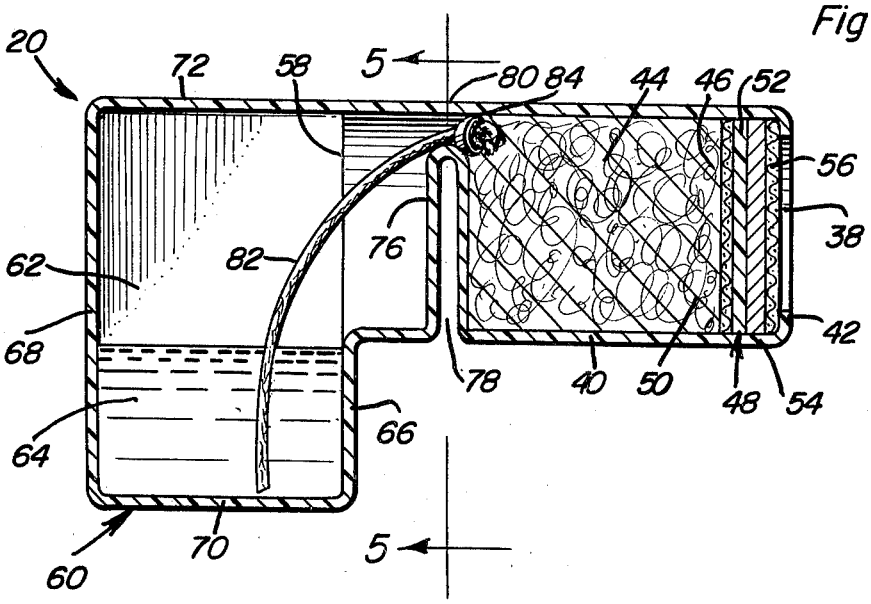
FIG. 4 is a side section view taken substantially through a plane indicated by section line 4—4 of FIG. 3.

The ink supply cartridge 20 as shown in FIGS. 1 and 2 are similar to the replaceable ink supply cartridges disclosed in my prior U.S. Pat. Nos. 3,662,682, 3,797,390 and 3,804,016 in that it includes an elongated tubular housing portion 40 of cylindrical shape having the opening 38 at one axial end defined by a radially inward projecting retainer flange 42. The tubular housing portion 40 provides an external mounting surface for the cartridge to either facilitate insertion or withdrawal from the marking apparatus or axial movement in the arrangement shown in FIG. 2. Also, the tubular housing portion encloses a cylindrical ink absorbent filler body 44 made of a plastic foam, as shown in FIG. 4. In some installations, exposure of the axial end 46 of the filler body 44 adjacent the open end 38 is restricted by a filter packing assembly 48 which is axially displaceable and yieldably held by the filler body in abutment with the retainer flange 42.

As shown in FIG. 4, the filter packing assembly 48 includes a wire mesh disc 50 in contact with end surface 46 of the filler body and a micro-pourous plastic disc 52. The porous disc 52 is in contact with a felt pad 54 stapled to a silk screen disc 56 exposed through the opening at end 38. The assembly 48 thus axially spaces the filler body 44 from the open end 38 and helps control the outflow of liquid ink.

In accordance with the present invention, the axial end 58 of the tubular housing portion 40, is connected to or integrally formed with an extension generally referred to by reference numeral 60. As more clearly seen in FIGS. 3, 4 and 5, the extension 60 is dimensionally enlarged transversely of the tubular housing portion 40 relative to its longitudinal axis so as to enclose a reservoir chamber 62 of relatively large volumetric capacity. A body of liquid ink 64 is thereby stored in chamber 62 as shown in FIG. 4. The disposition and shape of the extension 60 will nevertheless not interfere with mounting engagement of the cartridge on the surfaces of the tubular housing portion 40 nor disturb the ink outflow rate as will be explained hereinafter.

In the illustrated embodiment, the reservoir extension 60 is generally rectangular in shape and includes a connecting wall 66 extending along a plane perpendicular to the longitudinal axis of the housing portion 40 at its axial end 58. A planar back wall 68 parallel to wall 66 is interconnected therewith by parallel spaced bottom and top walls 70 and 72 and parallel spaced side walls 74. The top wall 72 is arranged in substantially tangential relation to the circular cross section of the tubular housing 40 at end 58. The planar walls of the reservoir extension thus extend the reservoir chamber 62 in a direction transversely of the tubular housing enclosing the filler body 44.

Figure 3:
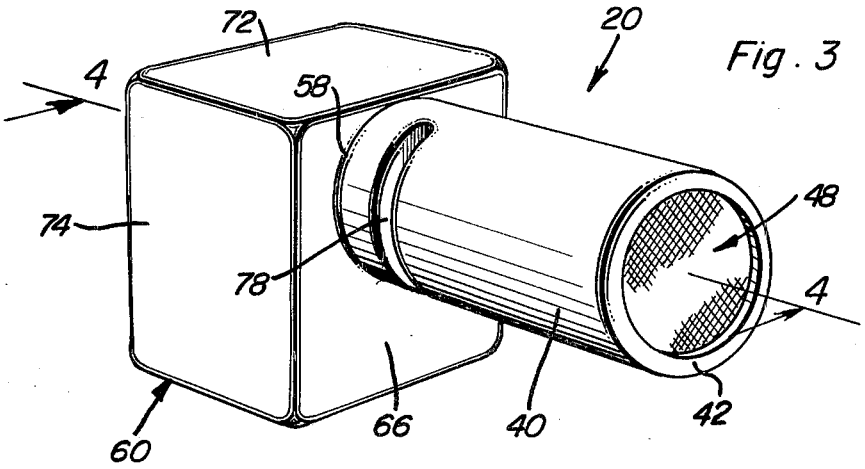
FIG. 3 is a perspective view of the ink supply cartridge itself.
Figure 5:
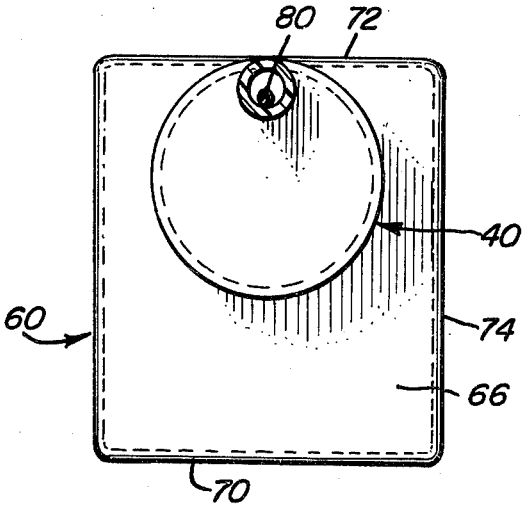
FIG. 5 is a transverse section view taken substantially through a plane indicated by section line 5—5 of FIG. 4.

With continued reference to FIGS. 3, 4 and 5, the tubular housing portion 40 is provided with an inward projecting formation 76 defining an indentation 78 aligned with a cross-sectional plane axially spaced from the adjacent end 58 of the tubular housing portion. The formation 76 forms a restricted passage 80 within the tubular housing portion and abuts the filler body 44 to retain it in an axially compressed state within the housing portion axially spaced from the reservoir chamber. The degree to which the filler body is compressed will control the quantity of ink stored therein and the flow rate of ink through the filter assembly 48 for dispensing through the open end 38.

A capillary flow of liquid ink to replenish the supply stored in the filler body, is conducted by an elongated wick 82 from the reservoir chamber to the filler body. The wick 82 made of felt or some other wicking material, extends from the body of liquid ink 64 through the restricted passage 80 into contact with the filler body within the tubular housing portion. The wick 82 is provided with a knotted portion 84 which is dimensionally larger than the flow area of the restricted passage 80 so as to prevent withdrawal of the wick from contact with the filler body and to seal the reservoir chamber. A relatively large quantity of fast drying ink may, therefore, be stored and sealed in the cartridge 20 and dispensed at the desired flow rate.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a marking apparatus having a movable element to which liquid is applied and a liquid storing supply device removably mounted by the apparatus for supply of the liquid to the element, said device comprising a compressible filler within which the liquid is absorbed and a cartridge housing enclosing a body of the liquid and the filler having an opening into which the element is projected for reception of the liquid from the filler, said housing including an elongated tubular portion within which the filler is disposed and a transversely enlarged extension of the tubular portion remote from the opening and enclosing a reservoir chamber containing said body of liquid, retainer means abutting the filler for holding the same within the tubular portion spaced from the reservoir chamber, and means in contact with the filler for sealing the reservoir chamber and conducting capillary flow therefrom to the filler within the tubular portion of the housing in response to movement of the element.

2. The combination of claim 1 including filter means spacing the filler from the opening in the housing and adapted to be contacted by the element.

3. The combination of claim 2 wherein said retainer means comprises an indentation in the tubular portion of the housing axially spaced from the transversely enlarged extension to form a restricted passage through which the sealing means extends.

4. The combination of claim 3 wherein said sealing means comprises an elongated wick having a knotted portion dimensionally larger than said restricted passage.

5. The combination of claim 4 wherein said tubular portion is generally cylindrical in shape while the transversely enlarged extension is rectangular in cross section.

6. The combination of claim 5 wherein said element is an ink transfer roller.

7. The combination of claim 1 wherein said element is a reciprocable print head.

8. The combination of claim 1 wherein said retainer means comprises an indentation in the tubular portion of the housing axially spaced from the transversely enlarged extension to form a restricted passage through which the sealing means extends.

9. The combination of claim 8 wherein said sealing means comprises an elongated wick having a knotted portion dimensionally larger than said restricted passage.

10. The combination of claim 1 wherein said tubular portion is generally cylindrical in shape while the transversely enlarged extension is rectangular in cross section.

11. In combination with a marking apparatus having a movable element to which liquid is applied and a liquid storing supply device removably mounted by the apparatus for supply of the liquid to the element, said device comprising a compressible filler within which the liquid is absorbed, a cartridge housing enclosing a body of the liquid and the filler having an opening into which the element is projected for reception of the liquid from the filler, said housing including an elongated tubular portion within which the filler is disposed and a transversely enlarged extension of the tubular portion enclosing a reservoir chamber containing said body of liquid, and an inwardly projecting retainer formation in the tubular portion of the housing abutting the filler in axially spaced relation to the transversely enlarged extension and forming a restricted passage through which the filler is exposed to the liquid in the reservoir chamber and means for conveying the liquid from the reservoir chamber to the filler through said restricted passage.

12. The combination of claim 11 wherein said tubular portion is generally cylindrical in shape while the transversely enlarged extension is rectangular in cross section.

13. The combination of claim 12 including filter means spacing the filler from the opening in the housing and adapted to be contacted by the element.

14. A liquid storing supply device for marking apparatus, or the like, comprising a tubular housing having opposite axial ends, a retainer flange projecting radially inwardly from the housing at one of said axial ends to form an opening, a reservoir extension connected to the housing at the other of the axial ends, said housing having an inwardly extending retainer formation adjacent to said other of the axial ends to form a restricted passage, a liquid absorbent filler disposed within the housing and held therein spaced from said other axial end by the retainer formation, and means within the restricted passage for conducting a limited flow of liquid from the reservoir extension to the filler.

15. The combination of claim 14 wherein said reservoir extension is an enclosure formed integrally with the housing and extending transversely therefrom.

* * * * *